US006209499B1

(12) United States Patent
Owen et al.

(10) Patent No.: US 6,209,499 B1
(45) Date of Patent: Apr. 3, 2001

(54) RETAINER GROOVE AND VARIABLE RESISTANCE ASSEMBLY

(75) Inventors: Nathan B. Owen, Holly, MI (US); Daniel Patrick O'Neill; Thomas Howard Lichti, both of Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/399,463

(22) Filed: Sep. 20, 1999

(51) Int. Cl.[7] ..... F01L 1/245

(52) U.S. Cl. ..... 123/90.55; 123/90.43; 123/90.46

(58) Field of Search ..... 123/90.39, 90.43, 123/90.45, 90.46, 90.48, 90.49, 90.5, 90.52, 90.55

(56) References Cited

U.S. PATENT DOCUMENTS 3,358,660 * 12/1967 Cornell ..... 123/90.55
5,365,897 * 11/1994 Speil et al. ..... 123/90.52
5,606,939 3/1997 Spath ..... 123/90.5
5,704,319 * 1/1998 Engelhardt et al. ..... 123/90.55
5,979,377 * 11/1999 Barth et al. ..... 123/90.12
6,039,018 * 3/2000 Spath ..... 123/90.55

* cited by examiner

*Primary Examiner*—Weilun Lo
(74) *Attorney, Agent, or Firm*—John A. Van Ophem

(57) ABSTRACT

A C-clip retainer is provided in a groove of a piston, such as for an engine hydraulic valve lash adjuster, to allow installation and removably retain the piston in a cylinder of an associated assembly. The groove has a novel shape including an inner surface that is angled relative to a longitudinal axis of the piston to provide a larger groove diameter at a first axial end surface and a smaller diameter at an opposite second axial end surface of the groove. Upon installation, the clip is urged into the smaller diameter, allowing easier installation, but upon removal the clip is expanded by forcing it to the larger diameter, thereby increasing the retention force on the piston. The first axial end surface may also be formed with a back angle that reduces forces of the associated cylinder edge that tend to compress the retainer into the groove, thus further increasing the piston retention force.

14 Claims, 3 Drawing Sheets

RETAINER GROOVE AND VARIABLE RESISTANCE ASSEMBLY

TECHNICAL FIELD

This invention relates to piston retention, especially for engine valve train lash adjusters.

BACKGROUND OF THE INVENTION

It is known in the art to retain the piston or body of an engine valve train lash adjuster by means of a C-clip positioned in a groove of the piston and engaging an abutment in the periphery of the cylinder in which the lash adjuster is installed. For example, a hydraulic element assembly or lash adjuster may be retained in a cylinder baffle of a direct acting cam follower; or a hydraulic lash adjuster by having a swivel foot for engaging a valve or other component may be retained in a cylinder recess of an associated rocker arm.

Typically in such arrangements, the C-clip is formed of resilient spring wire biased to spring outward against a bore or abutment in which the piston is reciprocably retained. The C-clip is retained in a groove on the exterior of the piston The groove has a depth such that, when added to the diametral clearance be een the piston and cylinder, the total exceeds the diameter of the spring wire of the C-clip. This is necessary to allow installation of the piston into a closed end cylinder without scratching or otherwise damaging the associated cylinder wall. The retaining groove typically has a cylindrical er surface and opposed upper and lower end surfaces, which are generally radial but may be sloped slightly outward for tool clearance.

To allow installation of the piston or body in a cylinder, the entry opening of the cylind r is generally angled to provide a lead-in cone angle. The cone angle com resses the C-clip into the piston groove and allows the piston with clip installed to be slid into the closed end cylinder and past a retaining abutment into operating position. The retaining abutment may be, for example, the upper edge of a baffle tube of a direct acting cam follower and its configuration is important in determining the ability of the C-clip to retain the hydraulic element assembly (HEA) in the cam follower cylinder.

For example, if the upper edge of the baffle tube is formed with a surface normal to the axis of the cylinder, that is horizontal when the cylinder axis is vertical, the retention of the piston in the cylinder by the expanded C-clip will be at a maximum since the horizontal or normal surface will not provide a substantial radial force for compressing the C-clip into the groove. Thus, if removal of the HEA is desired, it may be necessary to shear off the retaining parts of the C-clip in order to disassemble the assembly.

Since disassembly is sometimes required for inspection or replacement, the inner edge or abutment of the cylinder or baffle tube is generally sloped or angled downward and inward to provide a conical surface that engages the C-clip when retention or removal is desired. This angle may be varied as desired in order to maintain a sufficient force to retain the piston in place under anticipated operating conditions, while having a sufficient slope to allow removal of the lash adjuster or HEA from the cylinder when desired, without damaging the cylinder or HEA surface. The selection of the installation and retention angles on the cylinder edges is determined in part by the actual configuration of the C-clip and the diameter of wire from which it is made, as well as the depth of the retaining groove in which it is installed. These factors then, as well as the resilient force applied in expansion of the C-clip, all have a bearing on the selection of angles for accomplishing the various desired purposes of retention and ability to remove the HEA or lash adjuster when desired.

SUMMARY OF THE INVENTION

The present invention provides an improved lash adjuster assembly in a retaining cylinder based upon a piston having an improved cross-sectional configuration of the retaining groove in which the C-clip retainer is installed.

In a first feature of the invention, the retaining groove is made axially longer than is conventional so that the retainer clip may be slid between spaced upper and lower positions along the groove. The inner diameter of the groove is angled with the desired slope, referred to as the clip diameter assembly angle, which may be ten degrees more or less within a suitable operating range as conditions may require. For example, angles of five to fifteen or twenty degrees may be found useful in particular operating environments. The clip diameter assembly angle allows the clip to be compressed further during assembly of the piston within its cylinder than is permitted in the retention or removal condition of the assembly.

During assembly of the piston, the clip is pushed axially downward in the groove to the smaller diameter or deeper end of the groove so that the clip may be compressed further into the groove and provide a reduced rubbing force on the associated cylinder, thereby reducing the possibility of damage to the parts during assembly. After the piston is installed, attempted removal of the piston, either by operating forces or by attempted disassembly with tools, the retaining clip is forced upwardly in the groove to the larger diameter or shallower end where the retaining clip is urged outwardly to increase its resistance to compression into the groove. This increases the retaining force of the clip so that the assembly does not come apart too easily during operations.

An additional feature of the invention is the provision at the upper or retaining end of the groove of a clip retention back angle having an outward or upward slope of a suitable amount such as, for example, twenty degrees. The back angle cooperates with the bore retention angle formed at the upper edge of the associated cylinder so that the two angles together control the compression force acting on the C-clip to retain or allow removal of the piston from the cylinder.

As the clip retention back angle is increased to approach the bore retention angle, the radial compression force exerted by the bore retention angle during attempted disassembly of the piston from the cylinder, is reduced toward zero. Thus, reducing the clip retention back angle provides more positive retention of the piston in the cylinder but also makes it harder to remove the piston without damaging the cylinder or clip. Accordingly, selection of the clip retention back angle and bore retention angle are important in accomplishing the desired amount of force retaining the piston within the cylinder at this connection. The spring force of the clip and the diameter of the clip also need to be taken into account in determining the proper angles for the assembly.

In some cases, the bore retention angle is fixed by prior manufacturing practices. In such cases, the clip retention back angle may be adjusted as desired to provide the proper degree of retaining force while allowing removal of the piston for inspection or replacement.

These and other features and advantages of the invention will be more fully understood from the following description of certain specific embodiments of the invention taken together with the accompanying drawings.

DESCRIPTION OF THE PREFERRED EMBODIMENT

Figure 1:
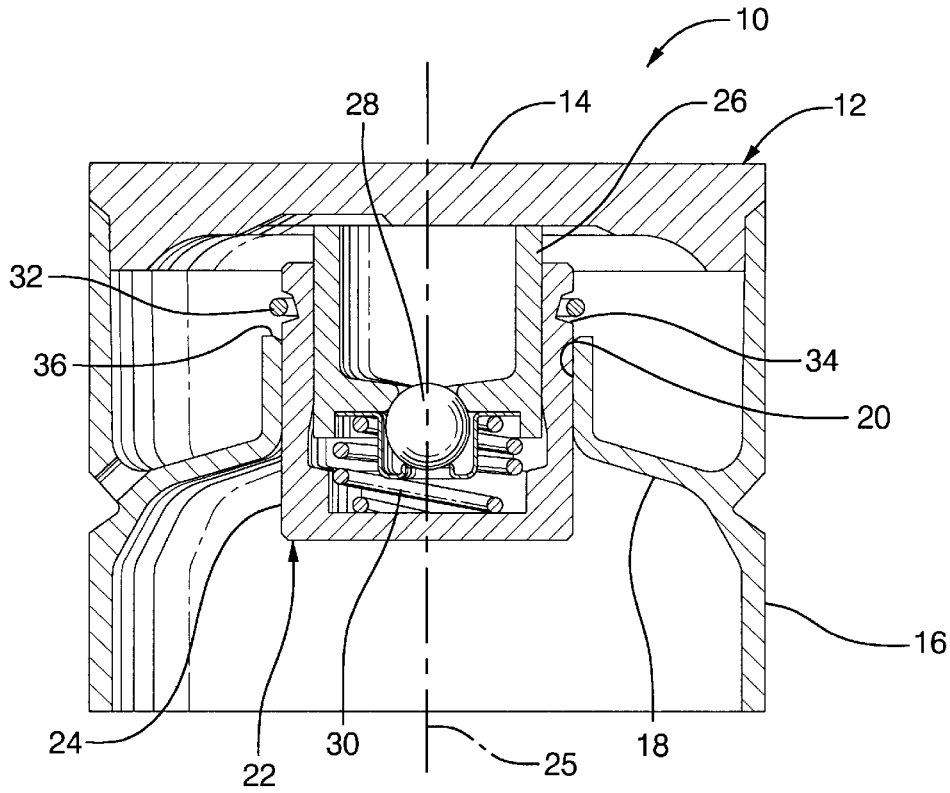
FIG. 1 is an axial cross-sectional view through a direct acting hydraulic valve lifter forming an assembly according to the invention.

Referring first to FIG. 1 of the drawings, there is shown a direct acting hydraulic valve lifter (DAHVL), generally indicated by numeral 10, and forming an assembly in accordance with the invention. Assembly 10 includes a housing in the form of a cam follower body 12 having a closed end 14 connected with an external cylindrical external wall 16. A baffle 18 portion of housing 12 extends inwardly from the interior of wall 16 and upwardly to form an internal cylinder 20 in which a hydraulic element assembly (HEA) 22 is received.

HEA 22 conventionally includes an open-ended piston 24 having an axis 25. Piston 24 is received within the cylinder 20 and internally receives a cylindrical plunger 26. The plunger includes a lower wall with a check valve 28, which together define a hydraulic chamber at the closed end of the piston. A spring 30 biases the plunger upward against the closed end of the follower body 12 when the DAHVL 10 is installed in an engine with the closed end of the piston 24 engaging an associated engine valve, not shown. In operation, oil pressure in the chamber leaks down slightly when the associated engine valve is opened and is replenished through the check valve when the engine valve is closed.

In order to retain the HEA 22 within the baffle cylinder 20, a spring wire C-clip or retainer clip 32 is mounted within an associated groove 34 in the exterior of the piston 24 shown in assembly 10 with the clip 32 above an upper end 36 of the cylinder 20. Conventionally, the assembly is completed by installing the retainer clip 32 in the clip groove 34 and inserting the assembled HEA 22 into the baffle cylinder 20 from the open end of the cam follower body 12. During this installation, the retainer clip 32 is compressed into the groove 34 and it expands resiliently after entry into the chamber above the upper end 36 of the baffle cylinder to retain the plunger within the cylinder prior to installation in an engine, and thereafter if required by abnormal engine operation.

Figure 2:
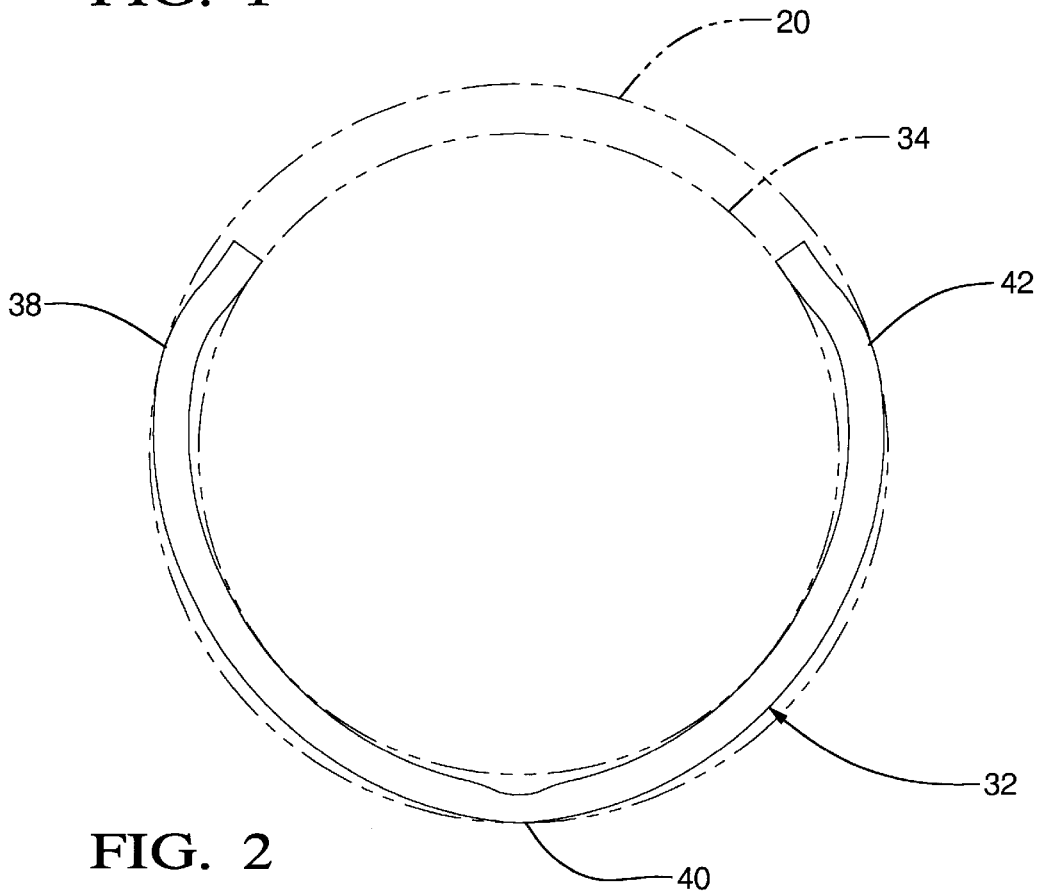
FIG. 2 is a plan view of a C-clip retainer shown schematically as confined in a piston retaining groove within a cylinder.

Referring now to FIG. 2, retainer C-clip 32 is shown as compressed within a piston groove indicated by the phantom line 34 and retained therein by the baffle cylinder 20 indicated by phantom line 20. The C-clip 32 may be formed of round or ovalized spring wire or other suitable material having a diametral gap that allows installation of the C-clip on the piston. The C-clip 32 is preferably formed with three outwardly projecting radii or bumps 38, 40, 42 at spaced locations about its major diameter. When the retainer clip 32 is expanded as the ring is pushed through the cylinder 20 into the upper chamber of a DAHVL, the bumps 38, 40, 42 extend outward beyond the internal diameter of the cylinder 20 and provide a retention force which maintains the HEA 22 within the cam follower body 12 during handling and normal operating conditions.

Figure 3:
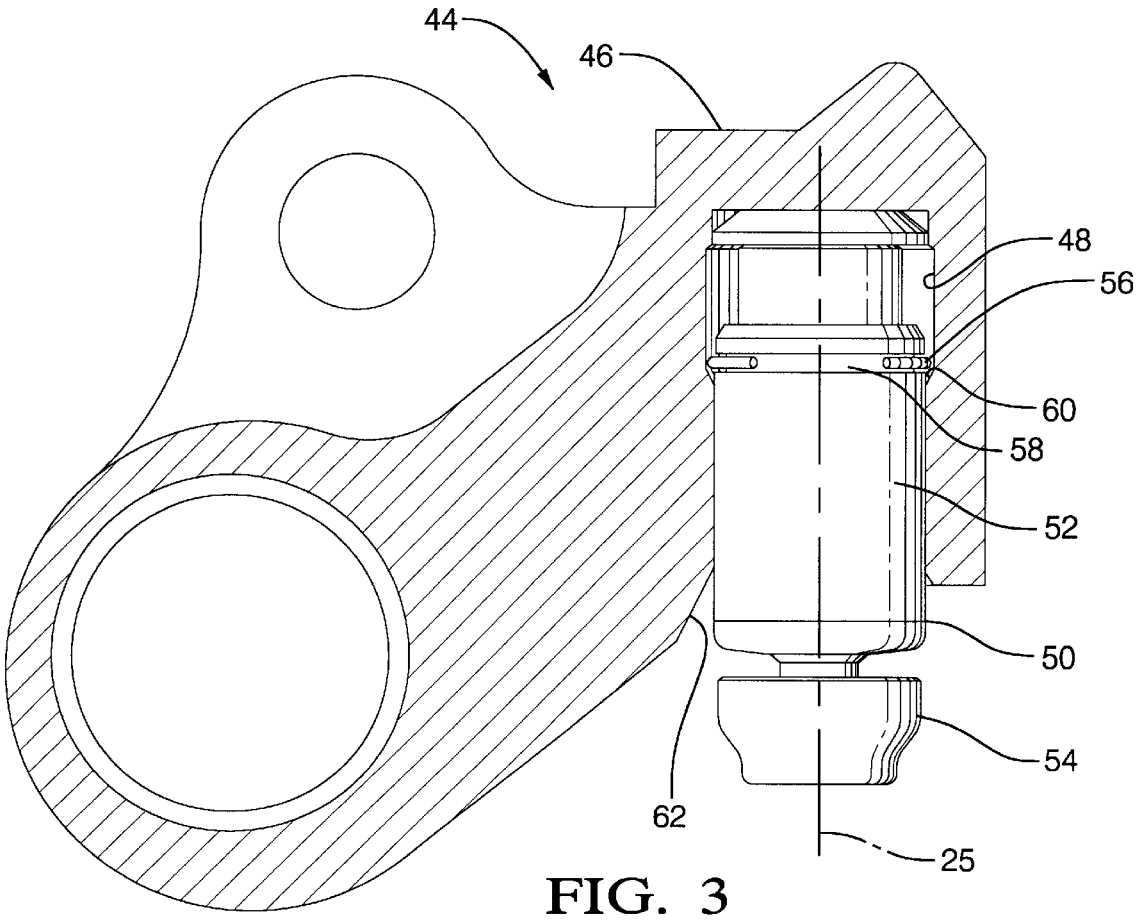
FIG. 3 is a cross-sectional view of a rocker arm and lash adjuster forming an alternative assembly according to the invention.

Referring now to FIG. 3, there is shown an alternative assembly 44 of a rocker arm 46 having a closed end cylinder 48 in which a hydraulic lash adjuster or hydraulic element assembly (HEA) 50 is received. HEA 50 is generally similar in internal construction and operation to HEA 22 previously described; however, its piston 52, formed on axis 25, includes a pivotable foot 54 for directly engaging an engine valve. The HEA 50 is again retained by a C-clip retainer 56 like that of retainer clip 32. Clip 56 is received in an external groove 58 around the upper end of the piston 52 and the clip is engagable with a conical surface 60 comprising a first angled abutment defining a bore retention angle at a stepped portion of the internal cylinder 48. A conical surface 62 forming an entry angle is provided at the lower open edge of the cylinder 48 forming a second angled abutment that allows easy installation of the HEA 50 into the cylinder 48 of the rocker arm.

Figure 4:
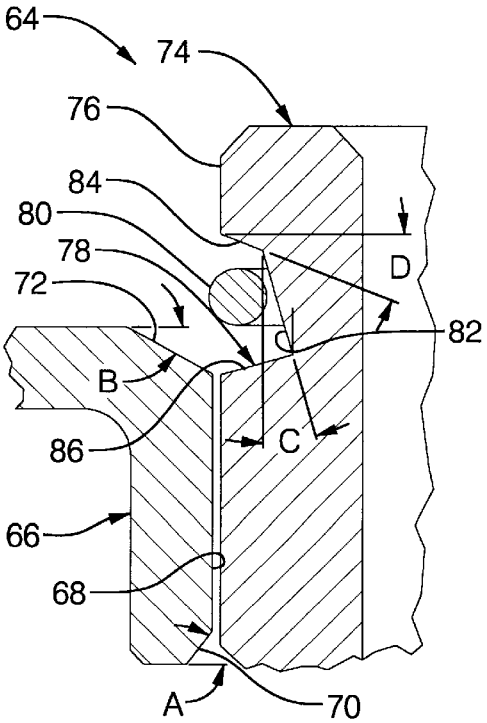
FIG. 4 is a schematic view showing associated features of an assembly according to the invention.

FIG. 4 represents schematically the retention elements of an assembly 64 according to the invention. The assembly 64 comprises a DAHVL including a baffle 66 defining a cylinder 68 having at its lower end a conical surface 70 forming an abutment with a conical entry angle A and at its upper end a conical surface 72 forming an abutment with a bore retention angle B. Within the cylinder 68 is a piston 74 of an HEA or other lash adjuster device, the piston including a cylindrical exterior 76 centered on an axis 25 (see FIG. 1) and containing a circular retainer groove 78. Within the groove and expanded into position for engagement with the bore retention angle 72 is a C-clip retainer 80 of the type illustrated in FIG. 2.

In accordance with the invention, the retainer groove 78 includes an inner surface 82 formed with an angle referred to as the clip diameter assembly angle C. Surface 82 extends between the inner edges of a first end surface 84 forming the upper edge of the groove 78, as shown, and a second end surface 86 forming the lower edge of the groove, as shown. The upper or first end surface 84 forms a back angle D sloping axially away from the groove 78 relative to a plane normal to the axis 25, (FIG. 1) and the exterior 76 of the piston 74 so as to widen the groove slightly on its open side. The second end surface 86 may be sloped slightly, as shown, or may be essentially horizontal as desired. The angle D of surface 84 is referred to as the clip retention back angle.

The function of the novel groove configuration and other associated surfaces in the installation and retention or removal of an HEA or lash adjuster in a housing defining a cylinder will now be described. To install the piston 74 in the baffle 66, the retainer 80 is first slid into place on the groove 78 of the piston. The piston 74 is then inserted from the bottom of the baffle 66, as shown in FIG. 4, so that, as the piston is raised, the retainer clip 80 first engages the entry angle A formed by surface 70 on the bottom edge of the baffle. The entry angle cams the C-clip 80 inwardly, compressing it into the groove 78, while at the same time, the clip is forced downward to engagement with the lower or second end surface 86 of groove 78. At this point, the diameter of the inner surface 82 is at a minimum due to the slope of the groove assembly angle C. Thus, the C-clip is easily compressed into the groove and allows upward motion of the piston with a minimum of C-clip force against the cylinder 68. This reduces the possibility of scratching or otherwise damaging the cylinder surface.

When the piston is fully installed, as shown in FIG. 4, attempted removal of the piston from the baffle requires downward motion of the piston relative to the cylinder 68. This causes the bore retention angle D formed by surface 84 to engage the retainer clip 80, forcing it upward in the groove 78 toward engagement with the upper or first end surface 84. By this motion, the retainer clip reaches the larger diameter end of the groove which creates greater resistance to compression of the C-clip 80 into the groove. Thus, the force of the clip is increased when it is in this position so that it provides a greater force tending to retain the piston within the baffle than was exerted by the clip during installation of the piston within the baffle. The increased retaining force provides increased resistance to accidental dislodgement of the piston from the baffle during handling prior to installation, as well as reducing the likelihood of separation of the components during abnormal operation of the engine after the assembly is installed therein.

Figure 5:
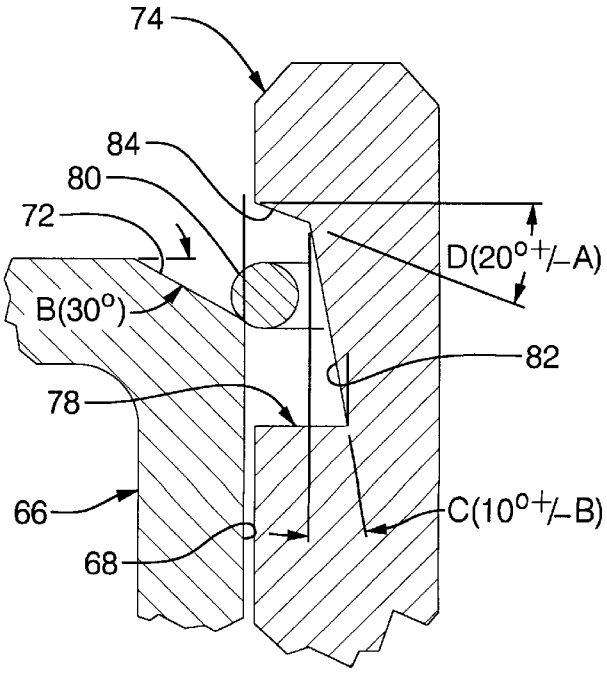
FIG. 5 is a schematic view illustrating a first embodiment of an assembly.
Figure 6:
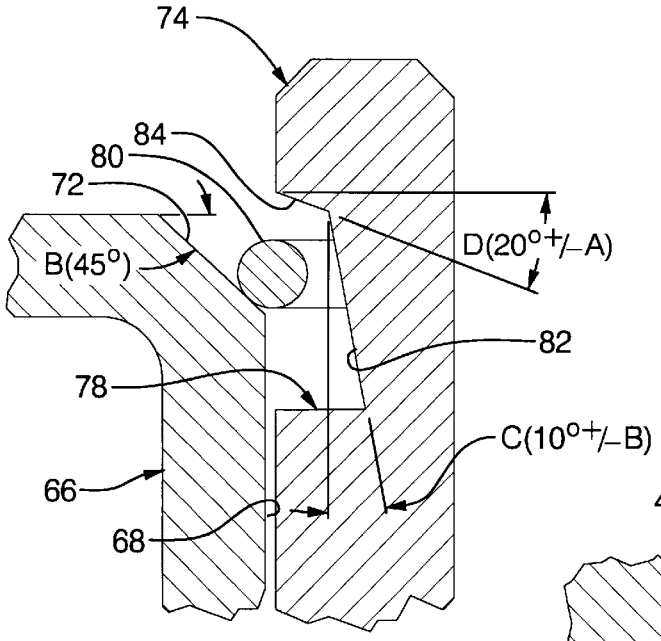
FIG. 6 is a schematic view illustrating a second embodiment of an assembly.
Figure 7:
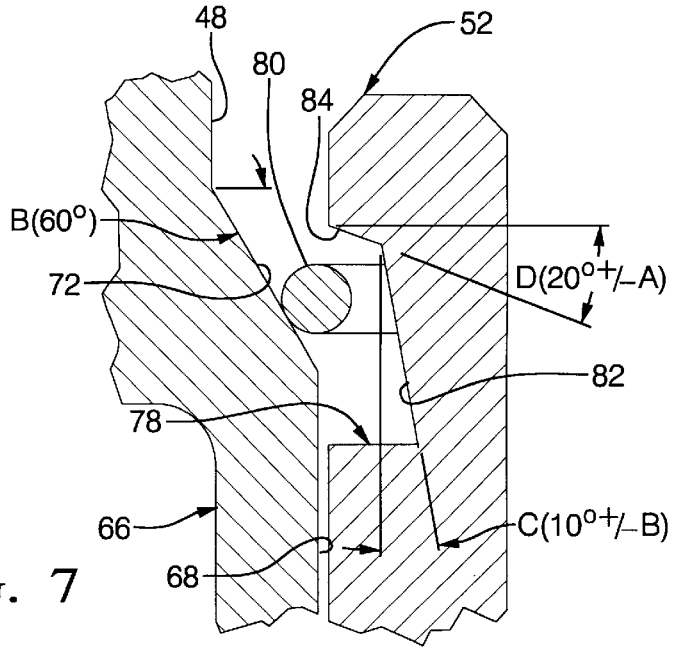
FIG. 7 is a schematic view illustrating a third embodiment of an assembly.

FIGS. 5–7 schematically illustrate various combinations of angles, which may reasonably be applied in various embodiments of lash adjuster installations having the novel groove 78 feature of the invention. FIG. 5 approximates the embodiment of FIG. 4 and illustrates a bore retention angle B of 30 degrees, a clip retention back angle D of about 20 degrees, and a clip diameter assembly angle C of about 10 degrees, the related clip retention and assembly angles being variable within reasonable limits.

In this embodiment, the small difference of 10 degrees between the bore retention angle B and clip retention back angle D provides a minimum of radial force for urging the C-clip 80 outward into the piston groove 78 when removal of the piston from the baffle is desired. With such a small angular differential, removal of the piston might require shearing off of part of the C-clip material in order to get the piston out of the baffle. To avoid this, it might be preferable to increase the bore retention angle B to 45 degrees or so, in order to increase the outward force on the C-clip so that easier removal of the piston from the baffle may be obtained.

FIG. 6 represents the suggested solution for the embodiment of FIG. 5 to provide easier withdrawal or removal of the piston from the baffle while still providing adequate retention for most purposes. In FIG. 6, the bore retention angle B is 45 degrees, while the clip retention back angle D remains at 20 degrees, more or less, and the clip diameter assembly angle C remains 10 degrees, more or less. This combination provides increased expanding force against the C-clip when removal of the piston is desired, and thus permits removal to be accomplished more easily and generally without damage to the bore of the cylinder.

Referring now to FIG. 7, an embodiment similar to that shown in FIG. 3 is illustrated, wherein the bore retention angle B is increased to 60 degrees, while the clip retention back angle D and clip diameter assembly angle C remain as before, 20 and 10 degrees approximately. With this combination, as illustrated, the expanding force against the C-clip 80 is significantly increased so that removal of the piston 52 from the cylinder 48 becomes easier, possibly to the extent that the piston will come loose from the assembly when such removal is not desired. To prevent this possibility, the bore retention angle B may be reduced to 45 degrees as previously shown or, alternatively, the clip retention back angle D could be increased to reduce the difference between the bore retention and clip retention angles.

Either alternative would reduce the outward force effectively acting on the C-clip 80 tending toward its expansion upon attempted removal of the piston 52 from the cylinder 48. Thus, if the bore retention angle B is fixed at some predetermined angle that is not advantageous with the piston angles usually provided, it is possible to vary the clip retention angle D or, in an alternative situation, the clip diameter assembly angle C to accomplish the desired forces on the assembly. Thus, the piston may be easily installed in the cylinder while the resistance to removal of the piston from the cylinder is increased to a level that is sufficient to maintain the parts in assembly without preventing their disassembly when and if desired.

Figure 8:
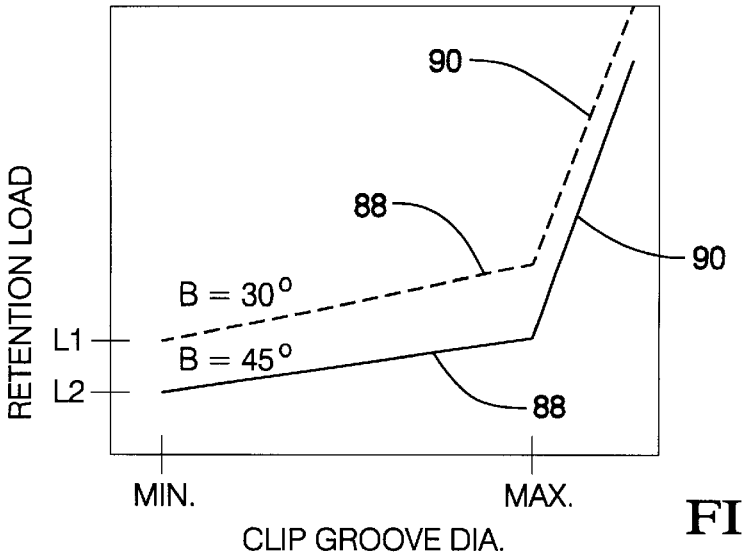
FIG. 8 is a graph illustrating variations in compression and shear resistance retention loads over a range of clip groove diameters.

FIG. 8 graphically illustrates the effects on piston retention force of varying clip groove diameter at two different bore retention angles B while wire diameter and bore diameter of the cylinder are held constant. As the groove diameter increases, the clip is increasingly expanded, increasing engagement with the bore retention angle and increasing retention load, as shown by lines 88. When the clip, as expanded by the groove, exceeds the associated cylinder bore diameter, the clip wire must be sheared to remove the piston from the cylinder leading to a more rapid increase in retention force, as indicated by lines 90. Further, the 45 degree bore retention angle B provides a lower retention force than the 30 degree bore retention angle B because the 45 degree angle applies a greater cam pressure force to the clip, urging it into the groove and reducing the retention force.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A piston for a valve train in an engine, the piston having an axis and a cylindrical exterior with a circular retainer groove around the exterior, said groove including:

first and second axially spaced end surfaces defining extremes of axial travel of a retainer clip when disposed in the groove; and an inner surface angled relative to the axis and extending between inner edges of said end surfaces to provide a larger diameter adjacent said first end surface and a smaller diameter adjacent said second end surface for expanding the clip in the groove adjacent the first end surface and allowing contraction of the clip when adjacent the second end surface, thereby varying the retaining force of the clip against movement of the piston past generally oppositely facing abutments of a cylinder surrounding the piston.

2. A piston as in claim 1 wherein said first end surface forms a back angle sloping axially away from the groove relative to a plane normal to said axis to form a groove widening surface for urging the clip against an associated abutment.

3. A piston as in claim 1 wherein the inner surface forms an inner diameter angle of from 5–15 degrees relative to the axis.

4. A piston as in claim 3 wherein said inner diameter angle is approximately 10 degrees.

5. A piston as in claim 2 wherein said back angle of the first end surface is in the range of from 10–30 degrees.

6. A piston as in claim 5 wherein said back angle is approximately 20 degrees.

7. A lash adjuster assembly for an engine valve train, said assembly comprising:

a housing defining an internal cylinder and having an open outer end and an enclosed inner end including an outwardly angled abutment spaced from and facing an interior wall of the housing;

an hydraulic element assembly (HEA) having a plunger engagable with the interior wall and telescopingly received within a piston having an axis and defining with the plunger an internal chamber, biasing means for axially expanding the chamber to take up lash and admit hydraulic fluid when the HEA is unloaded and means to limit the escape of fluid from the chamber when the HEA is under load during valve opening operations;

the piston having a cylindrical body reciprocably received within the cylinder and including a circular retainer groove around the exterior of the body; and an expandable retainer clip received within the groove, the clip being compressible within the groove for insertion of the HEA into and removal from the cylinder, the clip expanding upon axial positioning of the groove beyond the inner end of the cylinder to engage the cylinder inner end and removably retain the HEA in the cylinder of the housing;

wherein said groove includes:

first and second axially spaced end surfaces defining extremes of axial travel of the retainer clip within the groove; and a radially inner surface angled relative to the axis and extending between inner edges of said end surfaces to provide a larger diameter adjacent said first end surface and a smaller diameter adjacent said second end surface for expanding the clip in the groove when adjacent the first end surface and allowing contraction of the clip when adjacent the second end surface, thereby increasing the retaining force of the clip against removal of the HEA from the cylinder and reducing the resisting force of the clip against insertion of the HEA into the cylinder.

8. A lash adjuster assembly as in claim 7 wherein said first end surface of the groove forms a back angle sloping axially away from the groove relative to a plane normal to said axis to form a groove widening surface for urging the clip against said outwardly angled abutment.

9. A lash adjuster assembly as in claim 8 wherein said back angle lies in a range of from 20–30 degrees less than a retention angle formed on said housing abutment relative to a plane normal to said axis.

10. A lash adjuster assembly as in claim 7 wherein said retainer clip is formed of wire having a maximum diameter and said radially inner surface has a minimum depth adjacent said inner end surface of not less than said maximum wire diameter.

11. A lash adjuster assembly as in claim 7 wherein said inner surface forms an inner diameter angle of from about 5–15 degrees relative to the axis.

12. A lash adjuster assembly as in claim 11 wherein said inner diameter angle is approximately 10 degrees.

13. A lash adjuster assembly as in claim 7 wherein said retainer clip is made as a split annulus having a gap between split ends for installation of the clip in the groove of the piston body, said clip being resilient and set as installed in a free state such that at least two spaced points on the annulus extend beyond the groove periphery sufficiently to engage the cylinder inner end.

14. A lash adjuster assembly as in claim 13 wherein said annulus is bent outward at at least three spaced points each spaced less than 180 degrees from the next adjacent points.

* * * * *